United States Patent [19]

Manteufel

[11] 4,446,898

[45] May 8, 1984

[54] SELF-ELEVATING WOOD SPLITTER AND MOUNTING ARRANGEMENT

[75] Inventor: Dale A. Manteufel, Hortonville, Wis.

[73] Assignee: Ingersoll Equipment Co., Inc., Winneconne, Wis.

[21] Appl. No.: 486,933

[22] Filed: Apr. 20, 1983

Related U.S. Application Data

[63] Continuation-in-part of Ser. No. 385,787, Jun. 7, 1982, abandoned.

[51] Int. Cl.[3] ..... B27L 7/00

[52] U.S. Cl. ..... 144/193 A; 144/193 K; 280/415 R

[58] Field of Search ..... 403/3, 4, 232.1, 262; 144/193 R, 3 K, 193 A, 194, 193 K, 366; 280/415 R, 415 A

[56] References Cited

U.S. PATENT DOCUMENTS

| | | | |
|---|---|---|---|
| D. 261,143 | 10/1981 | Green . | |
| 3,760,854 | 9/1973 | Worthington | 144/193 A |
| 3,938,567 | 2/1976 | Dircksen et al. | 144/193 A |
| 4,112,985 | 9/1978 | Gosselin | 144/193 A |
| 4,141,396 | 2/1979 | McCallister | 144/193 A |
| 4,153,088 | 5/1979 | King et al. | 144/193 A |
| 4,199,015 | 4/1980 | Doering | 144/193 A |
| 4,236,556 | 12/1980 | Smith | 144/193 A |
| 4,246,942 | 1/1981 | Malik | 144/193 A |
| 4,258,765 | 3/1981 | Suomi | 144/193 A |
| 4,293,070 | 10/1971 | Burns | 144/193 A |

*Primary Examiner*—W. D. Bray

*Attorney, Agent, or Firm*—Dressler, Goldsmith, Shore, Sutker & Milnamow, Ltd.

[57] ABSTRACT

A hydraulic wood splitter is disposed which includes a mounting arrangement for effecting a fixed connection to a tractor or the like, and vertically positionable wood supporting frame adapted to be moved vertically with respect to the mounting arrangement. A four-bar linkage arrangement is provided to accommodate selective vertical positioning of the splitter's frame, with a locking arrangement provided for selectively locking the frame at any desired elevation. The splitter further includes a self-elevating mechanism which is adapted for operative association with the splitter's hydraulic actuator for effecting raising and lowering of the wood supporting frame. Notably, the mounting arrangement of the present splitter is adapted to permit the splitter to be mounted on different tractors having attachment points at differing heights, with the splitter still being mounted at the same relative elevation with respect to the ground.

24 Claims, 6 Drawing Figures

10
12
14
16
18
20
22
24
26
28
30
32
34
36
38
40
42
42'
44
46
48
50
52
54
56
58
60
62
64
66
68
70
76
80

SELF-ELEVATING WOOD SPLITTER AND MOUNTING ARRANGEMENT

CROSS-REFERENCE TO RELATED APPLICATION

This application is a continuation-in-part of application Ser. No. 385,787, filed June 7, 1982, and now abandoned.

BACKGROUND OF THE INVENTION

This invention relates to hydraulic wood splitters attachable to a tractor or similar piece of equipment, and, more particularly, to improvements in a self-elevating wood splitter including an improved mounting arrangement.

There is disclosed in commonly assigned co-pending application Ser. No. 380,687, filed May 21, 1982, and now abandoned, a log or wood splitter having self-contained means for raising or lowering the same as required. That wood splitter included a mounting plate for fixed attachment to the tractor. The log bed and cooperating cylinder and ram were connected to the mounting plate by a pair of four-bar linkages which maintained the bed in the horizontal position at all levels thereof. Elevator plates were mounted from certain of the links and an elevator link was pivotally attached to said elevator plates. The elevator link included a pressure bar which could be pivoted into an operational position whereby it was atop the log bed and in the path of the ram. When the ram was operated, the elevator link activiated the four-bar linkage to raise the log bed. Lowering of the bed was achieved by reversing the procedure so that the bed dropped by gravity and with the ram acting as a brake.

The wood splitter of the said co-pending application also included locking means for retaining the bed at the desired height. Those locking means comprised slotted links pivotally connected to one corner of the four-bar linkages and cooperating with threaded bolts and wing nuts associated with other of the links in the four-bar linkages. The hand-operated wing nuts first had to be loosened to permit the adjustment and then tightened sufficiently to lock in the desired height and resist loosening during the percussive and jarring wood splitting operations.

SUMMARY OF THE INVENTION

The subject invention provides a self-elevating wood splitter having all of the advantageous features of the machine disclosed in the said co-pending application. Thus, the invention retains the four-bar linkages, the mounting means requiring only a single fixed attachment to the tractor, and the tubular log bed with cylindrical sleeves slideably mounted thereon and connected to the ram. Additionally, this invention provides improved means for elevating and locking the machine in a desired position, and includes an improved arrangement for mounting the wood splitter on a tractor or the like. The improved mounting arrangement facilitates attachment of the splitter to different tractors or other implements having attachment points at differing elevations.

The present splitter includes elevator arms attached to the upper links of the four-bar linkages and the same converge and are joined at a point below the lower links, thereby forming a single point of attachment for the elevator means connectable to the ram. A strap or web is connected between the slidable sleeves adjacent their lower portions and a simple chain or the like is connectable between the strap and the joint of the elevator arms. Movement of the ram thereupon is effective to raise or lower the log bed.

Positive acting locking means are provided for retaining the machine in a given position. In general, the locking means comprises adjustment plates having suitably arranged locking holes formed therein. Retractable latching pins cooperate with the locking holes to positively lock in the desired height of the machine.

The improved mounting arrangement for the present invention includes a mounting plate pivotally interconnected with the upper and lower links of the four-bar linkages, and which thus forms a portion of the linkages. A novel invertible bracket arrangement is provided so that the mounting plate (and splitter) can be mounted on different tractors having attachment points at differing heights, while the wood splitter is positioned at generally the same elevation regardless of which tractor it is mounted on. The bracket arrangement includes upper and lower invertible brackets. The upper invertible bracket, which is preferably generally Z-shaped, is adapted to effect a releasably fixed connection to the tractor, as well as to an upper flange portion of the splitter's mounting plate. Similarly, a lower invertible bracket is adapted for effecting a releasably fixed connection with the tractor, and with a lower flange portion of the mounting plate.

In a first position of each mounting bracket, the mounting plate of the splitter can be connected to the brackets so that the splitter is mounted in a first, relatively low position with respect to the attachment points on the tractor. In a second, inverted position of each bracket, the mounting plate of the splitter can be affixed to the brackets so that the wood splitter is mounted in a second, relatively high position with respect to the attachment points of the tractor. This is a particularly desirable feature of the present invention since it maintains the selected range of relative vertical movement of the splitter's wood supporting frame with respect to the ground, even when the splitter is mounted on different tractors or the like.

Other features and advantages of the invention will be apparent from the following description and claims and are illustrated in the accompanying drawings which show structure embodying preferred features of the present invention and the principles thereof.

DESCRIPTION OF THE PREFERRED EMBODIMENT

Figures 1, 2:
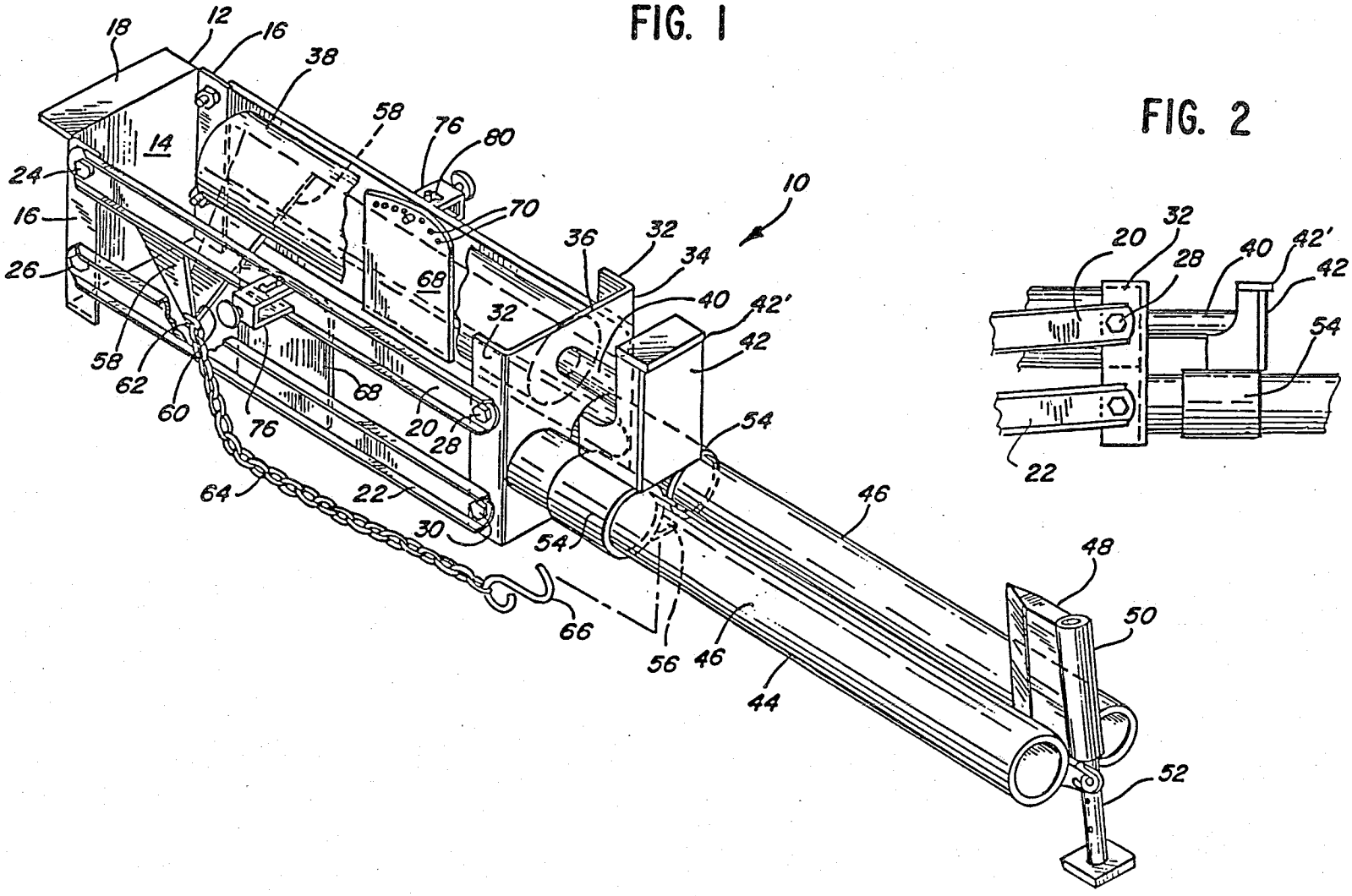
FIG. 1 is a perspective view of a wood splitting machine embodying the principles of the invention with portions broken away and certain conventional elements omitted for clarity of illustration.
FIG. 2 is a fragmentary side elevational view of the wood splitter shown in FIG. 1 illustrating the configuration of the splitting ram.

Turning now with greater particularity to the various figures of the drawings, it will be seen that the reference character 10 indicates generally an improved self-elevating wood splitter embodying the principles of the invention. In its basic structure, the wood splitter 10 may be similar to that shown and described in the said co-pending application of James L. Wirsbinski. Thus, the same comprises a front mounting plate 12 having a central wall 14, a pair of side walls 16, 16, and an integrally formed top wall 18 extending forwardly from the central wall. The front mounting plate 12 may be rigidly connected to a tractor or other vehicle by means of the top wall 18 and suitable bolts or other fasteners (not shown).

A top link 20 and a bottom link 22 are pivotally connected to each of the side walls 16 at 24 and 26 respectively. The opposite ends of the links 20 and 22 are pivotally connected at 28 and 30, respectively, to the side walls 32, 32, of a channel-shaped rear mounting plate 34. Mounting plate 34 comprises further a central wall 36 of substantially identical width with the central wall 14 of front mounting plate 12. Mounting plate side walls 16, 16 and 32, 32, together with the top links 20 and bottom links 22, thus comprise a pair of four-bar linkages.

A hydraulic cylinder 38 of conventional construction is mounted on the rear mounting plate 34 and includes a piston 40 extensible through an opening in the central wall 36 of said rear mounting plate, and conventional valve control means and hydraulic connections to the tractor (not shown). The piston 40 carries a ram 42 at its free end.

As best shown in FIGS. 1 and 2, ram 42 is preferably configured to act to retain a piece of wood being split in position during operation of the splitter. To this end, the ram 42 includes a generally vertically oriented wood-engaging surface or face, and a lip 42' which projects from the wood-engaging surface in the direction of the wood-splitting movement of the ram. Preferably, the lip 42' extends a substantial portion of the width of ram 42, with the lip 42' including a horizontal lower surface perpendicular to the wood-engaging surface of the ram.

The distal portion of the wood splitter 10 comprises an elongated log bed or frame 44 for retaining the workpiece thereon during the splitting operation. Frame 44 comprises a pair of spaced, parallel cylindrical tubes 46, 46, which are mounted from the central wall 36 of the mounting plate 34.

A stationary wedge 48 is permanently connected between the tubes 46 at the rear ends thereof and said wedge may comprise further a tubular rear edge 50 and be mounted at an acute angle to the plane of the frame 44 for the purposes and as described in the said co-pending application. A stabilizing standard 52 may likewise be provided for adjustable telescopic cooperation with the tubular rear edge 50.

A pair of cylindrical sleeves 54, 54, is slideably mounted on the tubes 46 and said sleeves are bridged by, and permanently affixed to, the bottom of the ram 42 to form an integrated, slideable unit therewith. A metal strap or web 56 is likewise permanently connected between the sleeves 54 tangential to the bottom surfaces thereof for reasons which will become apparent as the description proceeds.

A pair of elevator arms 58 are respectively rigidly attached to the inner surface of each of the top links 20 adjacent the front ends thereof. The arms 58 project downwardly and inwardly and are permanently joined at point 60 below the pivot points 26 and substantially midway between the four-bar linkages. A depending hook 62 is attached to the elevator arms 58 at the junction point 60.

A lift link is attached to the hook 62, and said lift link comprises a lift chain 64 which has a hook such as 66 at its opposite end. In order to activate the four-bar linkages and raise the wood bed 44, it is simply necessary to attach the hook 66 to the strap 56 under the sleeves 54 and operate the ram 42. When the desired level is achieved and locked into place, in a manner to be described, the hook 66 may be disconnected from the strap 56 for the wood splitting operations. To lower the bed 44, the described procedure is simply reversed.

The locking or latching means of the invention will now be described. A positioning plate 68 is rigidly mounted on each of the bottom links 22 intermediate the lengths of said links. The locking plates 68 project upwardly from the inner surfaces of the bottom links 22 to a point substantially level with the tops of the top links 20. Each of the locking plates 68 has formed therein, adjacent the top thereof, a plurality of spaced height selection holes 70. It will be noted that the height selection holes 70 are arcuately arranged, with the central hole thereof being positioned in substantial alignment with the midpoint of the top link 20 when the links 20 and 22 are in the horizontal position of FIG. 1.

Each of the top links 20 is provided with a central, latch pin hole (not shown). A spring-loaded latch pin assembly 76 is mounted on each of the top links 20 and said assembly comprises a channel-shaped frame 78 having a bayonet-type slot 80 in the top wall thereof, and a spring-loaded latching pin 82 having a stop projection 84.

When elevation of the machine is desired, and after attachment of the chain 64 to the strap 56, the latch pins 82 are withdrawn and rotated so that the stop projections 84 are seated in the short segment of the slot 80. With the latching pins thus retracted, the ram 42 may now be operated to elevate the machine. When the desired height is reached, the latching pins 82 are reverse rotated so that the projections are released and the latching pins are spring urged through the latch pin holes and aligned adjusting plate holes 70. In this regard, it will be appreciated that pivoting of the links 20 and 22 about the fixed pivot points 24 and 26 causes the locking plates 68 to likewise pivot with relation to the latch pin holes, bringing different ones of the openings 70 into alignment with said latch pin holes. There is thus achieved a positive locking action at the desired height which requires no tools or further adjustment and which will resist all inadvertent unlatching forces.

Lift chain 64 functions as a detachable link to transmit force from the ram to the four-bar linkages for raising or lowering the log bed. While the lift link has been shown as a chain, it will be appreciated that the same could also comprise other means such as a strap or a rigid bar of suitable length. Similarly, other forms of releasable connection between the lift chain and the sleeves 54 may be employed. For example, the hook 66 of the chain 64 could be connectable directly to the ram 42 through the space between the log bed tubes 46.

Figure 5:
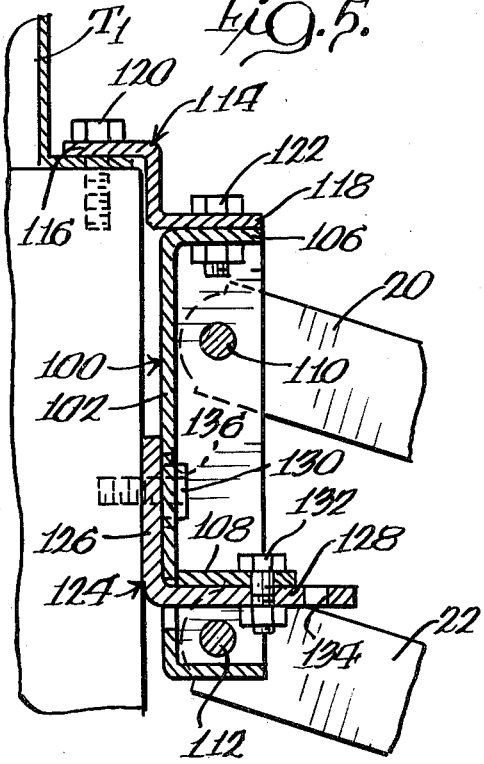
FIG. 5 is a side cross-sectional view illustrating mounting of the present splitter on the tractor shown in FIG. 3.
Figure 6:
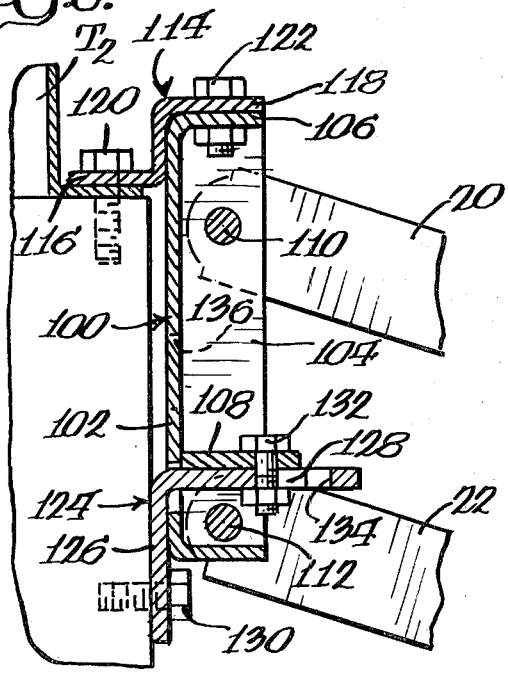
FIG. 6 is a side cross-sectional view illustrating mounting of the present splitter on the tractor illustrated in FIG. 4.

Referring now to FIGS. 5–6, an improved construction for the mounting arrangement of the present wood splitter is illustrated. Significantly, the improved mounting arrangement permits the splitter to be mounted on different tractors or the like having associated attachment points at differing elevations, with the wood splitter still being mounted at the same general vertical elevation from the ground.

Figure 3:
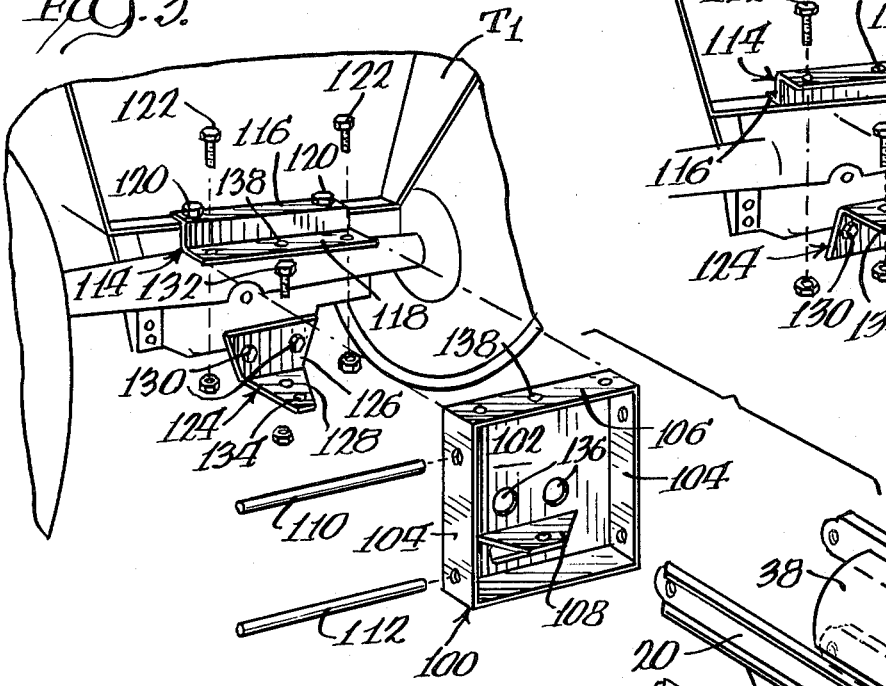
FIG. 3 is an exploded perspective view of an improved mounting arrangement of the present wood splitter illustrating mounting on a tractor having relatively low attachment points.
Figure 4:
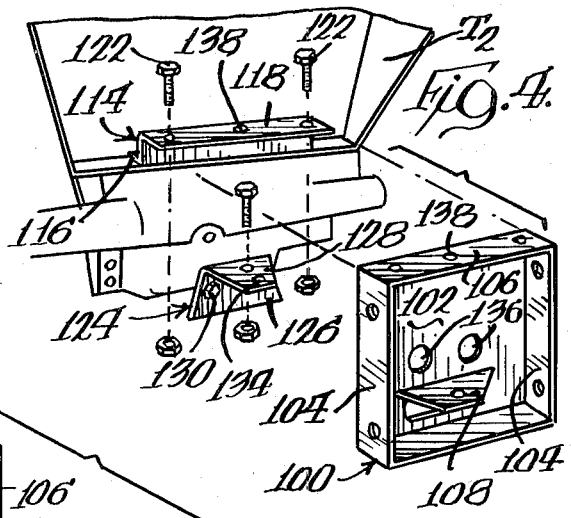
FIG. 4 is a perspective view similar to FIG. 3 illustrating the improved mounting arrangement in association with a tractor having relatively high splitter attachment points.
Figure 4:
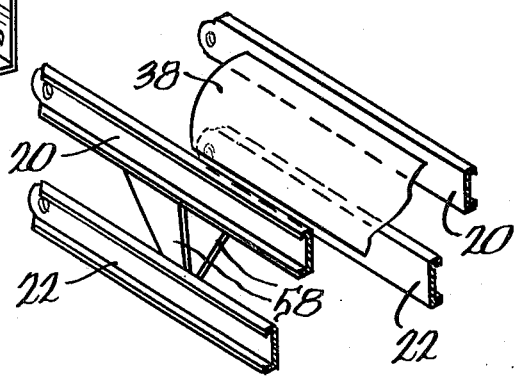

In FIGS. 3 and 5, a portion of tractor $T_1$ is illustrated having associated splitter attachment points which are relatively high from the ground. In contrast, FIGS. 4 and 6 illustrate a tractor $T_2$ having splitter attachment points which are relatively low to the ground. The improved mounting arrangement includes a modified mounting plate 100 which is adapted for pivotal interconnection with top and bottom links 20 and 22 in the manner of previously described mounting plate 12. In this regard, mounting plate 100 includes a central wall 102, side walls 104, an upper flange portion 106, and a lower flange portion 108 which preferably projects generally rearwardly from central wall 102. A pair of pivot pins 110 and 112 are preferably provided for releasably pivotally connecting the top and bottom links 20 and 22 of the splitter's four-bar linkages to mounting plate 100.

In order to accommodate mounting of the present wood splitter on different tractors having attachment points at different elevations, the mounting assembly includes an invertible bracket arrangement. Specifically, the assembly includes an upper invertible bracket 114, which in the illustrated embodiment is configured with a generally Z-shaped cross-section. Upper bracket 114 includes a flange portion 116 for effecting a releasable fixed connection with a tractor, and a flange 118, which is offset from flange 116, and which is provided for effecting a releasable connection with upper flange portion 106 of mounting plate 100. To this end, fasteners 120 are provided for coaction with flange 116 for affixing upper bracket 114 to a tractor, with fasteners 122 provided for connecting flange 118 of the bracket to upper flange portion 106 of mounting plate 100.

The invertible bracket arrangement further includes a lower invertible bracket 124, which in the illustrated embodiment is generally L-shaped in cross-section. The lower bracket 124 includes a flange 126 for effecting a releasable connection of the bracket to a tractor, and a flange 128 that is for releasable connection with lower flange portion 108 of mounting plate 100. A pair of fasteners 130 are provided for affixing flange 126 to a tractor, with a fastener 132 provided for releasably connecting flange 128 and flange portion 108. For enhancing the versatility of this arrangement, an accessory attachment hole 138 is preferably defined by flange 128 of lower bracket 124, with hold 134 accommodating attachment of a wheeled cart or the like to a tractor upon which the lower bracket is mounted.

Referring now to FIGS. 3 and 5, the above-described mounting arrangement is illustrated in association with tractor $T_1$ having associated attachment points which are relatively high. For mounting the wood splitter on this tractor, fasteners 120 are used to affix upper bracket 114 to the tractor $T_1$ so that flange 118 of the bracket is positioned below flange 116 of the bracket. Lower bracket 124 is affixed to tractor $T_1$ with fasteners 130 so that flange 128 of the bracket is positioned generally below flange 126. In this first, upright position of each of upper and lower brackets 114 and 124, the brackets appear generally as illustrated in FIG. 3.

In order to releasably connect mounting plate 100 to brackets 114 and 124, the mounting plate is very conveniently affixed to the brackets with fasteners 122 and 132. In this regard, central wall 102 of mounting plate 100 preferably defines one or more openings 136, with the openings 136 being adapted to respectively receive the head portions of fasteners 130. To further facilitate mounting, flange 118 of upper bracket 114, and flange portion 106 of mounting plate 100 preferably each define an alignment hole 138. A drift punch or like tool can be inserted into holes 138 as mounting plate 100 of the wood splitter is moved into association with upper and lower brackets 114 and 118 to thus facilitate alignment of the holes which receive the various fasteners which releasably connect the mounting plate with the brackets.

Referring now to FIGS. 4 and 6, the mounting arrangement is illustrated in association with a tractor $T_2$ having associated attachment points which are relatively lower than the attachment points of the above-described tractor $T_1$. In order to permit the wood splitter to be correctly positioned with respect to the ground for its full range of vertical movement, upper and lower brackets 114 and 124 are each inverted from their positions illustrated in FIGS. 3 and 5 to their positions illustrated in FIGS. 4 and 6. In this second, inverted position of each of the brackets, flange 118 of bracket 114 is positioned above flange 116, and flange 128 of bracket 124 is positioned generally above flange 126, with the brackets appearing generally as in FIG. 4. Mounting plate 100 of the wood splitter can then be releasably fixedly connected to the brackets with fasteners 122 and 132, with the mounting plate 100 again generally sandwiched between the upper and lower mounting brackets. As will be observed, the spacing between flange 118 of bracket 114, and flange 128 of bracket 124 is the same when the brackets are respectively in either their upright or inverted positions.

As will be recognized, the versatility provided by the above-described mounting arrangement is particularly desirable for mounting of a wood splitter in accordance with the present invention. This is because the wood splitter is movable through a generally fixed range of vertical movement, and it is desirable to maintain a selected range of relative vertical movement of the splitter's wood supporting frame with respect to the ground, regardless of the height of the attachment points of its associated tractor or the like. However, it will be recognized that a mounting arrangement as embodied by the present invention can be readily adapted for mounting an implement other than a wood splitter on an associated tractor or the like, and is especially desirable for mounting an implement at the same general elevation with respect to the ground on different tractors having attachment points at differing heights. It will also be recognized that the present mounting arrangement can be readily adapted for detachably mounting an implement on a tractor or the like at different elevations.

While a preferred embodiment has been illustrated and described herein, changes and variations may be made by those skilled in the art without departing from the spirit and scope of the appended claims. The invention is defined by the claims that follow.

What is claimed is:

1. A wood splitter adapted to be mounted on a tractor, or the like, comprising:

mounting means for effecting a fixed connection of said wood splitter to said tractor;

an elongated wood supporting frame extending rearwardly of said mounting means;

link means pivotally interconnecting said wood supporting frame and said mounting means to provide four-bar linkage means for vertical movement of said frame with respect to said mounting means;

hydraulic ram means operatively associated with said wood supporting frame and movable therealong;

elevator means associated with said four-bar linkage means and adapted for operative connection with said ram means whereby operation of said ram means effects raising and lowering of said wood supporting frame; and locking means for selectively locking said frame at a desired elevation, including locking plate means associated with said four-bar linkage means, said locking plate means defining arcuately spaced opening means adapted for selective cooperative engagement by latch means on said link means, said ram means including a wood-engaging surface, and horizontally extending lip means projecting from said surface in the direction of the wood-splitting movement of said ram means for retaining wood on said frame during splitting, said lip means including a lower surface perpendicular to the wood-engaging surface of said ram means.

2. A wood splitter adapted to be mounted on a tractor, or the like, comprising:

mounting means for effecting a fixed connection of said wood splitter to said tractor;

an elongated wood supporting frame extending rearwardly of said mounting means;

link means pivotally interconnecting said wood supporting frame and said mounting means to provide four-bar linkage means for vertical movement of said frame with respect to said mounting means;

hydraulic splitting means operatively associated with said wood supporting frame and movable with respect thereto;

elevator means associated with said four-bar linkage means and adapted for operative connection with said hydraulic splitting means whereby operation of said splitting means effects raising and lowering of said wood supporting frame; and locking means for selectively locking said frame at a desired elevation, including locking plate means associated with said four-bar linkage means, said locking plate means defining arcuately spaced opening means adapted for selective cooperative engagement with latch means on said link means, said mounting means having means thereon permitting said splitter to be mounted at generally the same height from the ground on different tractors having associated attachment points a differing heights from the ground.

3. The wood splitter in accordance with claim 2, wherein said mounting means comprises a mounting plate pivotally connected with said link means, and invertible bracket means for releasably fixedly connecting said mounting plate to said tractor.

4. The wood splitter in accordance with claim 3, wherein said invertible bracket means comprises an upper invertible bracket and a lower invertible bracket, said upper bracket being adapted for releasably fixed connection with said tractor and upper flange means of said mounting bracket, said lower invertible bracket being adapted for releasably fixed connection with said tractor and lower flange means of said mounting bracket.

5. The wood splitter in accordance with claim 4, wherein each of said upper and lower bracket means includes a flange adapted for respective connection with said upper and lower flange means of said mounting bracket, the spacing between said flanges of said upper and lower bracket means being generally the same in respective upright and inverted positions of said brackets.

6. The wood splitter in accordance with claim 4, wherein said hydraulic splitting means comprises a splitting ram having a wood-engaging surface, and a horizontally extending retaining lip projecting from said surface and including a lower surface perpendicular to the wood-engaging surface of the ram.

7. A wood splitter adapted to be mounted on a tractor, or the like, comprising:

mounting means for effecting a fixed connection of said word splitter to said tractor;

an elongated wood supporting frame extending rearwardly of said mounting means;

link means pivotally interconnecting said wood supporting frame and said mounting means to provide four-bar linkage means for vertical movement of said frame with respect to said mounting means;

cutting wedge means and ram means adapted to coact with each other for splitting wood on said frame;

hydraulic actuator means for relatively moving said wedge means and ram means for effecting wood splitting elevator means associated with said four-bar linkage means and adapted for operative connection with said hydraulic actuator means whereby operation of said actuator means effects raising and lowering of said wood supporting frame; and locking means for selectively locking said frame at a desired elevation, including locking plate means associated with said four-bar linkage means, said locking plate means defining arcuately spaced opening means adapted for selective cooperative engagement by latch means on said link means.

8. The wood splitter in accordance with claim 7, wherein said mounting means includes a mounting plate having spaced sidewalls pivotally connected to said link means, and upper and lower flange portions, said mounting means further including an upper invertible bracket having a flange adapted for releasable connection with said upper flange portion of said mounting plate, and a lower invertible bracket having a flange adapted for releasable connection with said lower flange portion of said mounting plate, said upper and lower brackets being adapted for releasable connection to said tractor in respective upright and inverted positions, the spacing between the flanges of said brackets being generally the same in the upright and inverted positions thereof.

9. The wood splitter in accordance with claim 8, wherein said flange of said upper bracket and said upper flange portion of said mounting plate each define an alignment opening, said alignment openings being adapted to receive an associated tool to facilitate connection of said mounting plate with said upper and lower brackets.

10. The wood splitter in accordance with claim 7, said ram means including a wood-engaging surface, and horizontally extending lip means projecting from said surface including a lower horizontal surface perpendicular to said wood-engaging surface.

11. In a wood splitter of the character described having mounting means for a fixed connection to a tractor or the like, an elongated wood supporting frame, a pair of four-bar linkages pivotally connecting said wood supporting frame to said mounting means, a hydraulic ram associated with said wood supporting frame and movable thereover, and wedge means associated with said frame for coaction with said ram to effect wood splitting, the improvement comprising:

lift means mounted with respect to said four-bar linkages and located therebetween;

a lift link having first and second ends carried by said lift means at the first end thereof;

connector means for releasably connecting the second end of said lift link to said ram whereby movement of the ram effects raising or lowering of said wood supporting frame; and locking means associated with said four-bar linkages for releasably locking said wood supporting frame at a desired elevation.

12. The wood splitter of claim 11 in which each of said four-bar linkages comprises a top link and a bottom link pivotally connected to said mounting means, and said lift means comprises a pair of rigid arms respectively connected to each of said top links, said arms projecting inwardly and downwardly from said top links of said four-bar linkages and being joined at a junction point substantially midway between said four-bar linkages.

13. The wood splitter of claim 12 in which said junction point lies below the point of pivotal connection of said bottom link to said mounting means.

14. The wood splitter of claim 12 in which said lift link is connected to said rigid arms at said junction point.

15. The wood splitter of claim 11 in which said wood supporting frame comprises a pair of spaced parallel tubes, and a pair of cylindrical sleeves slideably mounted on said tubes and rigidly connected to said ram whereby said ram and sleeves move as a unit, said connector means being connectable to said sleeves.

16. The wood splitter of claim 15 in which said connector means comprises a strap connected between said sleeves and a hook on the opposite end of said lift link engageable with said strap.

17. The wood splitter of claim 12 in which said locking means comprises a pair of locking plates respectively mounted on each of said bottom links of said four-bar linkages and projecting upwardly therefrom, a plurality of arcuately arranged holes formed in each of said plates, and retractable latching means on each of said top links of said four-bar linkages adapted to engage any one of said holes aligned therewith to maintain the wood supporting frame at a selected elevation.

18. The wood splitter of claim 17 in which said latching means each comprises a channel-shaped frame, a spring-urged latching pin carried by said frame and normally urged through one of said holes in the respective one of said plates aligned therewith, and means for retaining said latching pin in a retracted position out of engagement with said one hole.

19. The wood splitter of claim 18 in which said last-mentioned means comprises a bayonet-type slot formed in said frame and a stop projection carried by said latching pin and slideable in said slot.

20. A wood splitter comprising:

a front mounting plate adapted to be fixedly connected to a tractor or the like;

a pair of top links and a pair of bottom links, one each of said top links and said bottom links being respectively pivotally connected to each lateral edge of said front mounting plate;

a rear mounting plate pivotally connected at each of its lateral edges to a respective one of said top links and bottom links whereby said plates and links form a pair of four-bar linkages;

a pair of spaced parallel tubes projecting rearwardly from said rear mounting plate and adapted to support a wood workpiece thereon;

a stationary splitting wedge rigidly mounted between said tubes adjacent the rear end thereof;

a hydraulic cylinder mounted on said rear mounting plate and including a piston extensible through an opening in said rear mounting plate;

a ram mounted on said piston and movable over said tubes toward said splitting wedge;

a pair of cylindrical sleeves slideably mounted on said tubes and rigidly connected to said ram so that said ram and sleeves move as a unit;

a pair of elevator arms respectively rigidly mounted from each of said top links, said elevator arms projecting downwardly in opposed relationship and being joined together at a junction point substantially midway between said four-bar linkages;

an elevator link carried by said elevator arms from said junction point;

cooperating connector means on said elevator link and cylindrical sleeves for releasably engaging said elevator link and sleeves together so that movement of said ram activates said four-bar linkages to elevate said rear mounting plate and tubes; and locking means mounted on said bottom links for releasably locking said tubes in a selected elevation.

21. The wood splitter of claim 20 in which said connector means comprises a hook on the free end of said elevator link and a strap rigidly connected between said sleeves adjacent the bottom surfaces thereof.

22. The wood splitter of claim 21 in which said elevator link comprises a link chain.

23. The wood splitter of claim 20 in which said locking means comprises a pair of a locking plates respectively rigidly mounted on each of said bottom links and projecting upwardly therefrom, a plurality of arcuately arranged holes formed in each of said plates, and a pair of retractable latching means respectively on each of said top links each adapted to engage any one of said holes of the respective one of said plates aligned therewith to maintain the tubes and rear mounting plate at a selected elevation.

24. The wood splitter of claim 23 in which each said latching means comprises a channel-shaped frame having a bayonet-type slot formed in a wall thereof, a spring-urged latching pin carried by said frame and normally urged into engagement with one of said holes in said respective locking plate in alignment therewith, and a stop projection carried by said latching pin and slidable in said slot for retaining said latching pin in a retracted position out of engagement with said one hole.

* * * * *